US009863408B2

(12) United States Patent
Campbell et al.

(10) Patent No.: US 9,863,408 B2
(45) Date of Patent: Jan. 9, 2018

(54) SLIPPER RETAINER FOR HYDRAULIC UNIT

(71) Applicant: Hamilton Sundstrand Corporation, Charlotte, NC (US)

(72) Inventors: Kris H. Campbell, Poplar Grove, IL (US); Glenn C. Lemmers, Jr., Loves Park, IL (US); Doren C. Smith, Rockford, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 428 days.

(21) Appl. No.: 14/598,291

(22) Filed: Jan. 16, 2015

(65) Prior Publication Data

US 2016/0208784 A1 Jul. 21, 2016

(51) Int. Cl.

| | |
|---|---|
| ***F04B 1/12*** | (2006.01) |
| ***F04B 1/20*** | (2006.01) |
| ***F03C 1/06*** | (2006.01) |

(52) U.S. Cl.

CPC ..... *F04B 1/126* (2013.01); *F03C 1/0671* (2013.01); *F03C 1/0673* (2013.01); *F04B 1/2078* (2013.01); *F04B 1/2085* (2013.01); *F04B 1/2092* (2013.01)

(58) Field of Classification Search

CPC ..... F04B 1/126; F04B 1/2085; F04B 1/2092; F03C 1/0671; F03C 1/0673

USPC ..... 92/71

See application file for complete search history.

(56) References Cited

U.S. PATENT DOCUMENTS

| | | | | | |
|---|---|---|---|---|---|
| 3,292,553 | A * | 12/1966 | Hann | F01B 3/0041 | 91/485 |
| 3,303,794 | A * | 2/1967 | Hagemann | F01B 3/0032 | 91/506 |
| 3,382,793 | A * | 5/1968 | Gantzer | F01B 3/0041 | 91/499 |
| 3,678,804 | A * | 7/1972 | Heyl | F01B 3/0088 | 91/507 |

(Continued)

FOREIGN PATENT DOCUMENTS

| | | |
|---|---|---|
| DE | 3222210 | 12/1983 |
| DE | 102006042677 A1 | 1/2008 |
| DE | 102010036199 A1 | 3/2012 |

OTHER PUBLICATIONS

International Search Report, International Application No./Patent No. 16151672.9-1608, dated Jun. 24, 2016, European Patent Office; International Search Report 8 pages.

*Primary Examiner* — Thomas E Lazo

(74) *Attorney, Agent, or Firm* — Cantor Colburn LLP

(57) ABSTRACT

A slipper retainer of a hydraulic unit having a circular body having a back surface and an outer edge, the circular body defining a diameter of about 2.240 inches (5.629 cm), a central aperture through a center of the circular body, the circular body having a curved surface defining an edge of the central aperture, wherein the curved surface is defined by a sphere that is centered at a point located a distance of about 0.209 inches (0.531 cm) from the back surface of the body, and a plurality of slipper apertures located between the curved surface of the circular body and the outer edge of the circular body, wherein each slipper aperture of the plurality of slipper apertures has a diameter of about 0.464 inches (1.179 cm).

11 Claims, 6 Drawing Sheets

(56) References Cited

U.S. PATENT DOCUMENTS

| | | | | |
|---|---|---|---|---|
| 5,381,724 | A * | 1/1995 | Kawahara | F01B 3/0041 417/218 |
| 5,704,272 | A | 1/1998 | Durako et al. | |
| 5,862,704 | A * | 1/1999 | Seljestad | F04B 1/2085 74/60 |
| 5,950,520 | A * | 9/1999 | Kurosawa | F04B 27/0882 417/269 |
| 6,352,017 | B1 * | 3/2002 | Ryuh | F04B 1/2078 92/129 |
| 7,975,600 | B2 * | 7/2011 | Beck | F04B 1/126 92/57 |
| 8,037,808 | B2 * | 10/2011 | Bergmann | F04B 1/124 92/57 |
| 9,506,456 | B2 * | 11/2016 | Sitzler | F04B 1/126 |
| 2011/0094375 | A1 | 4/2011 | Beck | |
| 2014/0186196 | A1 | 7/2014 | Mizoguchi et al. | |
| 2014/0328702 | A1 * | 11/2014 | Riediger | F04B 27/0839 417/269 |
| 2014/0360352 | A1 * | 12/2014 | Sitzler | F04B 1/126 92/57 |
| 2015/0260153 | A1 * | 9/2015 | Kato | F04B 1/02 91/505 |

* cited by examiner

SLIPPER RETAINER FOR HYDRAULIC UNIT

BACKGROUND OF THE INVENTION

Exemplary embodiments of this invention generally relate to an integrated drive generator, and more particularly, to a slipper retainer of a hydraulic unit of an integrated drive generator.

Aircrafts currently rely on electrical, pneumatic, and hydraulic systems for secondary power. A typical electrical system utilizes an integrated drive generator coupled to each engine of the aircraft to provide a fixed frequency power to a power distribution system and associated loads. One type of integrated drive generator includes a generator, a hydraulic unit, and a differential assembly arranged in a common housing. The differential assembly is operably coupled to an aircraft engine, such as a gas turbine engine, via an input shaft. The rotational speed of the input shaft varies during the operation of the engine. The hydraulic unit cooperates with the differential assembly to provide a constant speed to the generator throughout engine operation.

Due to engineering designs and requirements various components of the systems must be designed to operatively function together. For example, various components of the hydraulic unit are configured to appropriately and accurately mate and fit together to enable efficient operation.

BRIEF DESCRIPTION OF THE INVENTION

According to one embodiment of the invention, a slipper retainer of a hydraulic unit is provided. The slipper retainer includes a circular body having a back surface and an outer edge, the circular body defining a diameter of about 2.240 inches (5.629 cm), a central aperture through a center of the circular body, the circular body having a curved surface defining an edge of the central aperture, wherein the curved surface is defined by a sphere that is centered at a point located a distance of about 0.209 inches (0.531 cm) from the back surface of the body, and a plurality of slipper apertures located between the curved surface of the circular body and the outer edge of the circular body, wherein each slipper aperture of the plurality of slipper apertures has a diameter of about 0.464 inches (1.179 cm).

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example, with reference to the drawings.

DETAILED DESCRIPTION OF THE INVENTION

Figure 1:
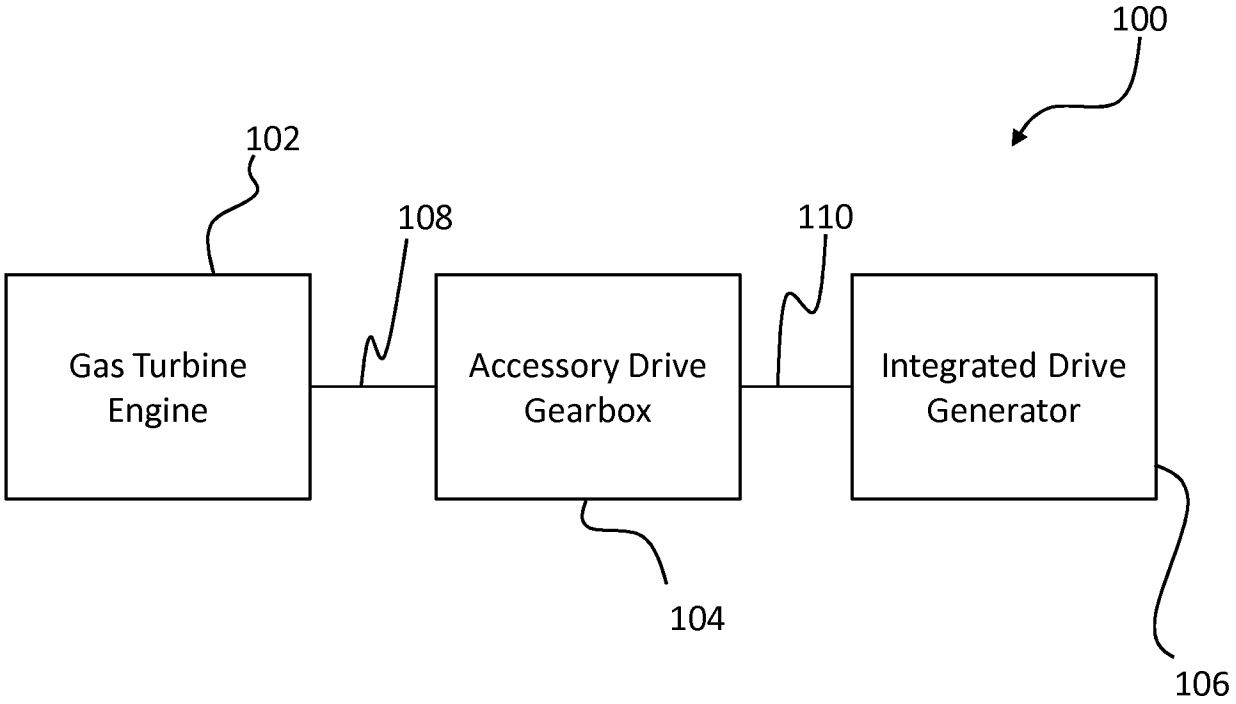
FIG. 1 is a schematic diagram of an exemplary power generator system of an aircraft.

Referring now to FIG. 1, an example of a generator system 100 is schematically illustrated. The generator system 100 includes a gas turbine engine 102 that is configured to rotationally drive an integrated drive generator 106 through an accessory drive gearbox 104 mounted on the gas turbine engine 102. The accessory drive gearbox 104 is coupled to a spool 108 of the gas turbine engine 102, and the speed of the spool 108 varies throughout the entire operation of the gas turbine engine 108, depending on operational characteristics, such as high altitude cruising flight or take-off of the aircraft. An input shaft 110 is configured to transfer rotational energy to the integrated drive generator 106 from the accessory drive gearbox 104. Those skilled in the art will appreciated that the generator system of FIG. 1 directed to an aircraft is merely presented for illustrative and explanatory purposes and other generators systems and/or engines may be used without departing from the scope of the invention.

Figure 2:
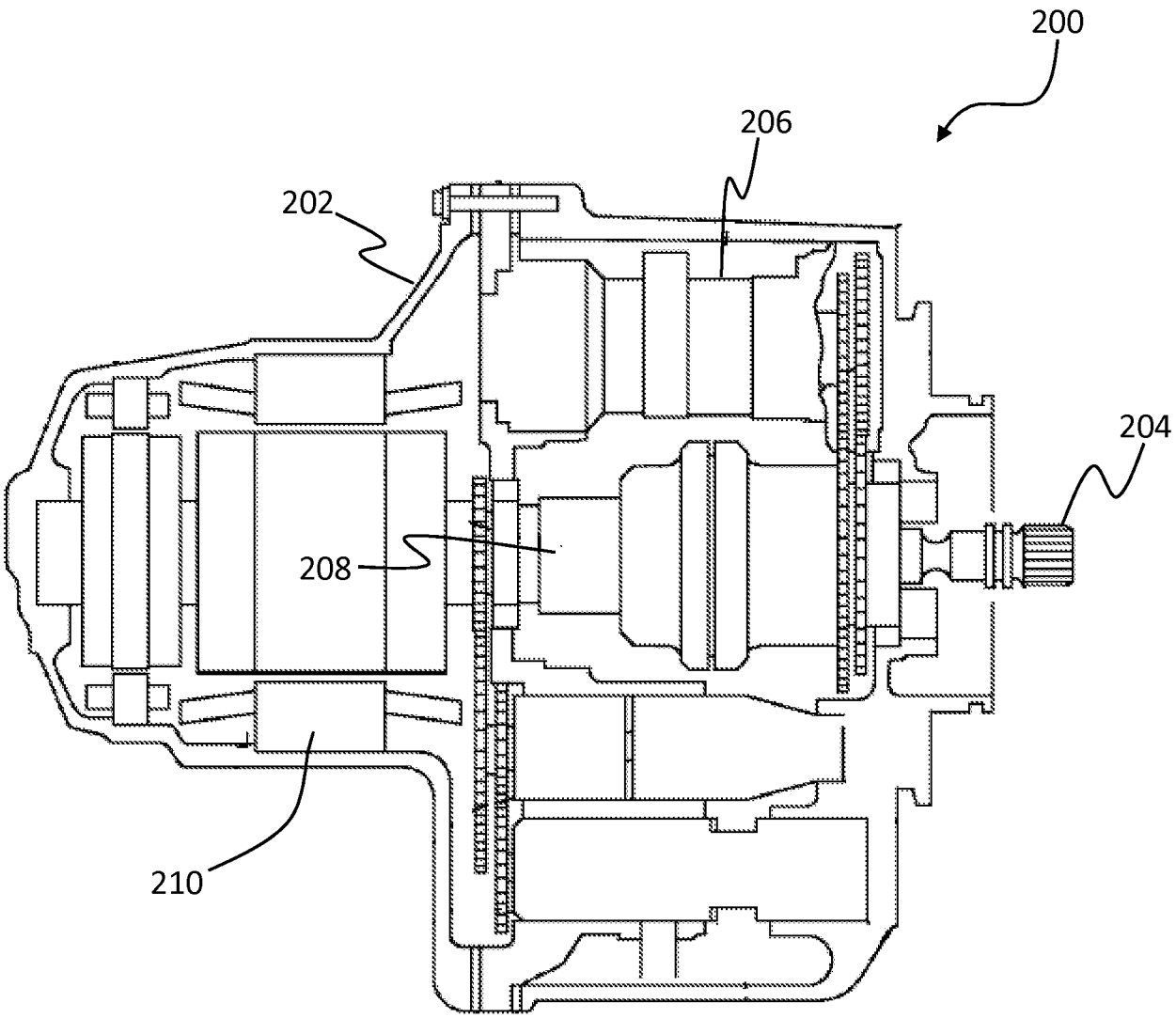
FIG. 2 is a cross-sectional schematic view of an example of an integrated drive generator.

An example of an integrated drive generator 200 including a housing 202 is shown in FIG. 2. In the illustrated embodiment, the integrated drive generator 200 includes an input shaft 204 configured to receive rotational drive from an accessory drive gearbox (see FIG. 1). The rotational speed of the input shaft 204 varies depending upon the operation of the engine (see FIG. 1). To this end, a hydraulic unit 206 cooperates with a differential assembly 208 to convert the variable rotational speed from the input shaft 204 to a fixed rotational output speed that is transferred to a generator 210.

Figure 3:
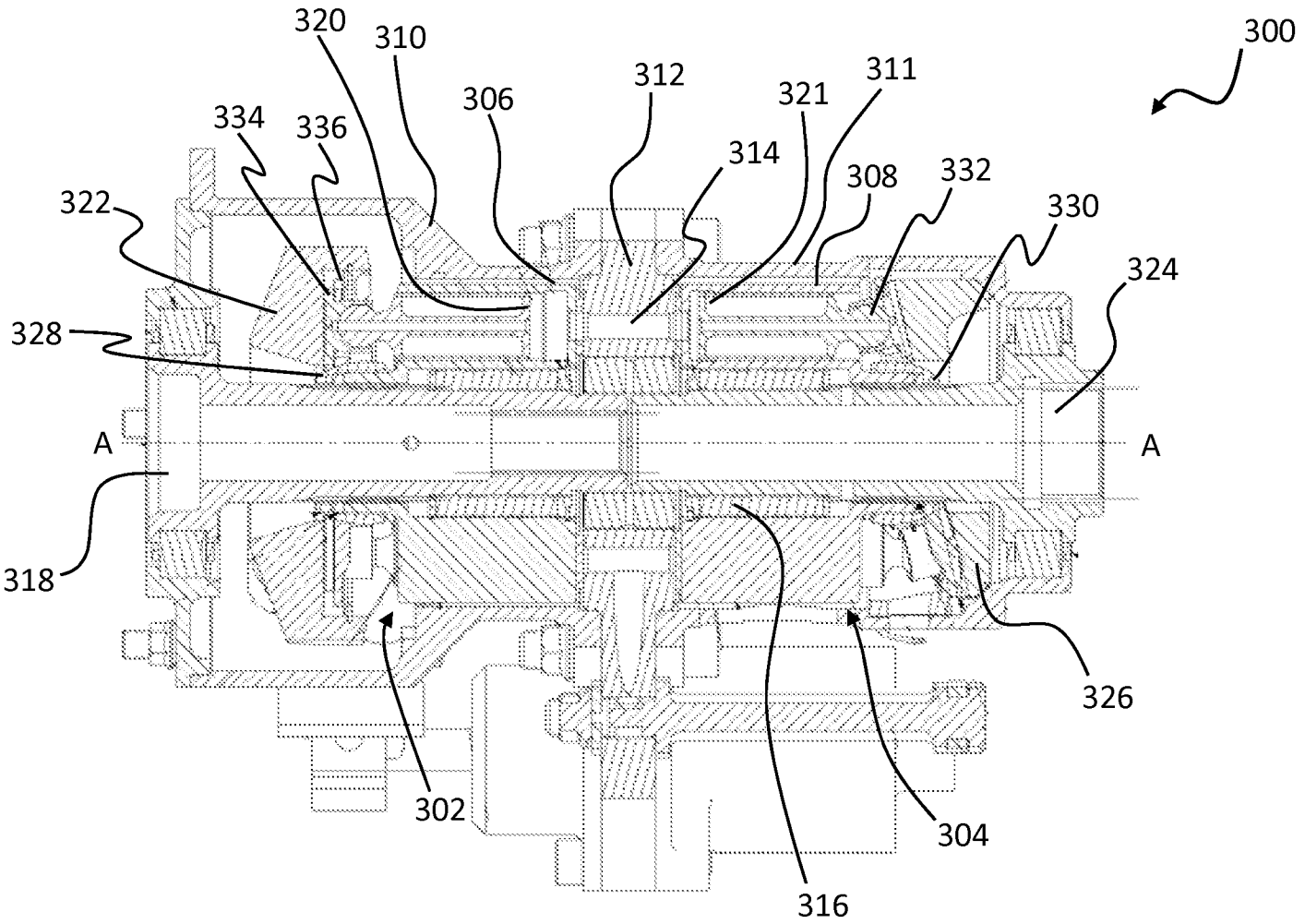
FIG. 3 is a cross-sectional schematic view of an example of a hydraulic unit of an integrated drive generator.

Referring now to FIG. 3, an exemplary embodiment of a hydraulic unit 300 of an integrated drive generator is shown. The hydraulic unit 300 includes a variable displacement hydraulic pump 302 and a fixed displacement hydraulic motor 304. The variable displacement hydraulic pump 302 and the fixed displacement hydraulic motor 304 have respective cylinder blocks 306 and 308 which are arranged for rotation about a common axis A within housings 310, 311 on opposite sides of a stationary port plate 312 of the hydraulic unit 300. The port plate 312 is formed with one or more kidneys or apertures 314 through which hydraulic fluid communication between the pump 302 and the motor 304 is established during normal operation of the hydraulic unit 300. A biasing mechanism 316 resiliently biases the cylinder blocks 306, 308 in the direction of the port plate 312.

The operation of the hydraulic unit 300 in an integrated drive generator, for example an integrated drive generator of an aircraft, involves transmission of torque from an engine of the aircraft to an input, which rotates an input shaft 318 of the hydraulic unit 300 about axis A. The cylinder block 306 of the pump 302 is connected to the input shaft 318 for rotation therewith. Pistons 320 within the cylinder block 306 of the pump 302 are displaced during rotation an amount which is a function of the setting of a variable swash plate or wobbler 322 of the pump 302. Similarly, pistons 321 within the cylinder block 308 of the motor 304 are displaced during rotation an amount which is a function of the setting of a variable swash plate or wobbler 322 of the pump 302. Those of skill in the art will appreciate that any number of pistons and associated apertures may be employed without departing from the scope of the invention. For example, in one exemplary embodiment, the system may include nine pistons in each of the motor and the pump, and nine apertures may pass through the port plate. Further, for example, the number of apertures is not dependent on the number of pistons, and in some embodiments there may be five apertures when nine pistons are employed. Thus, the number of pistons and the number apertures may be varied without departing from the scope of the invention.

Hydraulic fluid under pressure from the hydraulic pump 302 is delivered to the hydraulic motor 304 through the apertures 314 of port plate 312 for rotating the cylinder block 308 and an output shaft 324 to which the cylinder block 308 is fixedly connected. The swash plate or wobbler 326 of the motor 304 is fixedly configured so that an operating speed of the motor 304 is a function of a displacement of the pump 302. The rotary output from output shaft 324 is added to or subtracted from the rotary motion from the engine through a conventional differential gearing of an integrated drive generator for operating an electrical generator at a substantially constant rotational speed. That is, since the speed of the rotation from the aircraft engine to the input shaft 318 of the hydraulic unit 300 will vary, the position of the variable wobbler 322 is adjusted in response to these detected speed variations for providing the necessary reduction or increase in the rotational speed for obtaining a desired constant output speed to the generator. During normal operation, there is a hydrostatic balance of the cylinder blocks 306, 308 and port plate 312. Although the hydraulic unit 300 illustrated and described herein refers to the variable unit as a pump 302 and the fixed unit as a motor 304, hydraulic units having other configurations, such as where the variable unit functions as a motor and the hydraulic unit operates as a pump for example, are within the scope of the invention.

During operation, the wobbler 322 is permitted to turn, rotate, tumble, and/or wobble about a retainer ball 328. The wobbler 322 is configured to wobble, etc., in part, as a result of the movement of the pistons 320, 321, respectively. A retainer ball 330 is configured to turn or rotate with respect to the wobbler 326. Each piston 320, 321 has a ball 332 (ball of piston 320 not labeled for clarity) on one end. The ball 332 of the pistons 320, 321 is retained within a slipper 334. The slipper 334 is retained by a slipper retainer 336. The slipper retainer 336 enables the slipper 334 to be held in contact with the wobbler 322, 326, thus enabling operational coupling and/or contact between the wobblers 322, 326 and the pistons 320, 321, respectively, of the pump 302 and the motor 304.

Figure 4A:
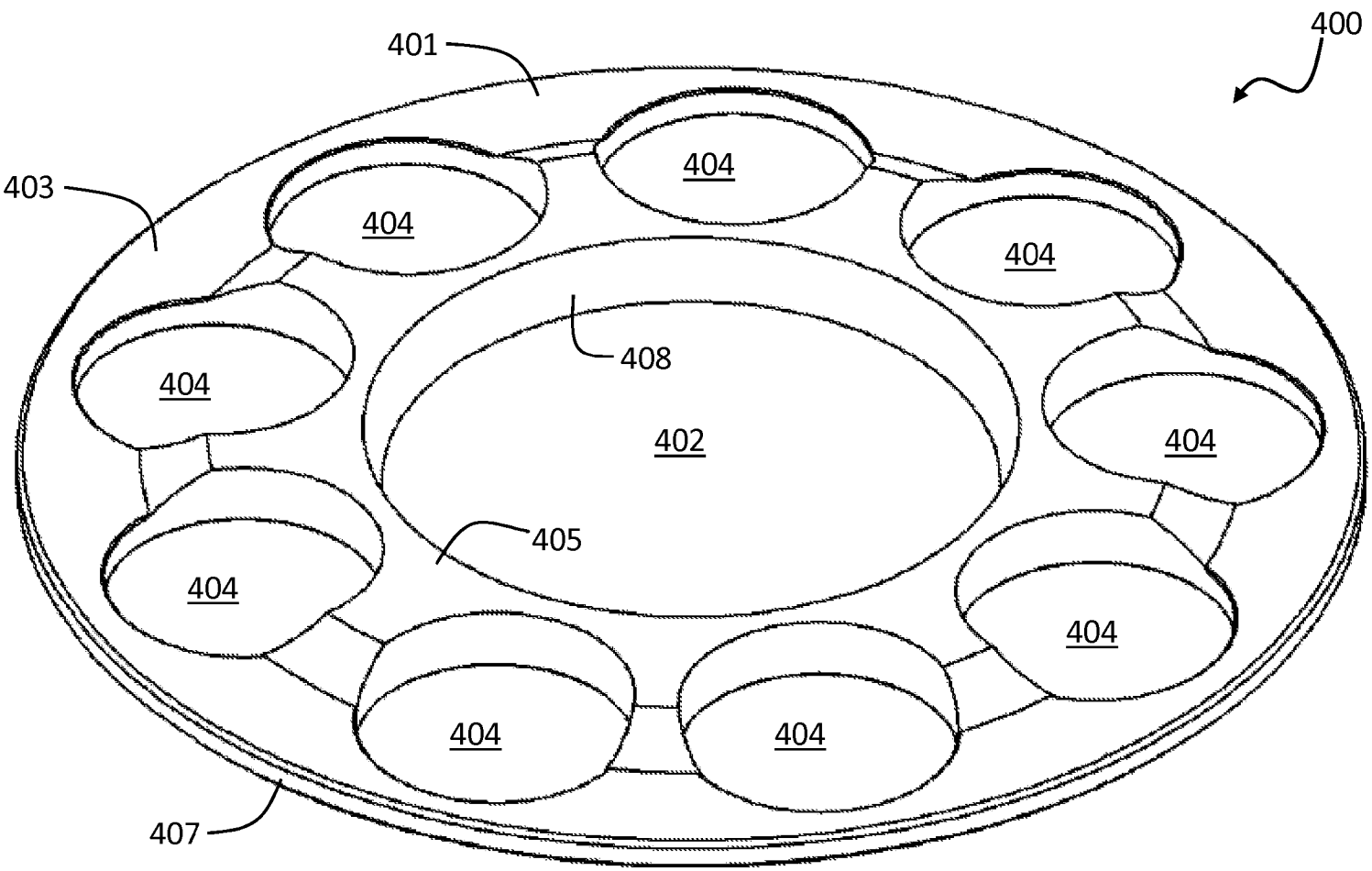
FIG. 4A is an isometric view of a slipper retainer in accordance with an exemplary embodiment of the invention.
Figure 4B:
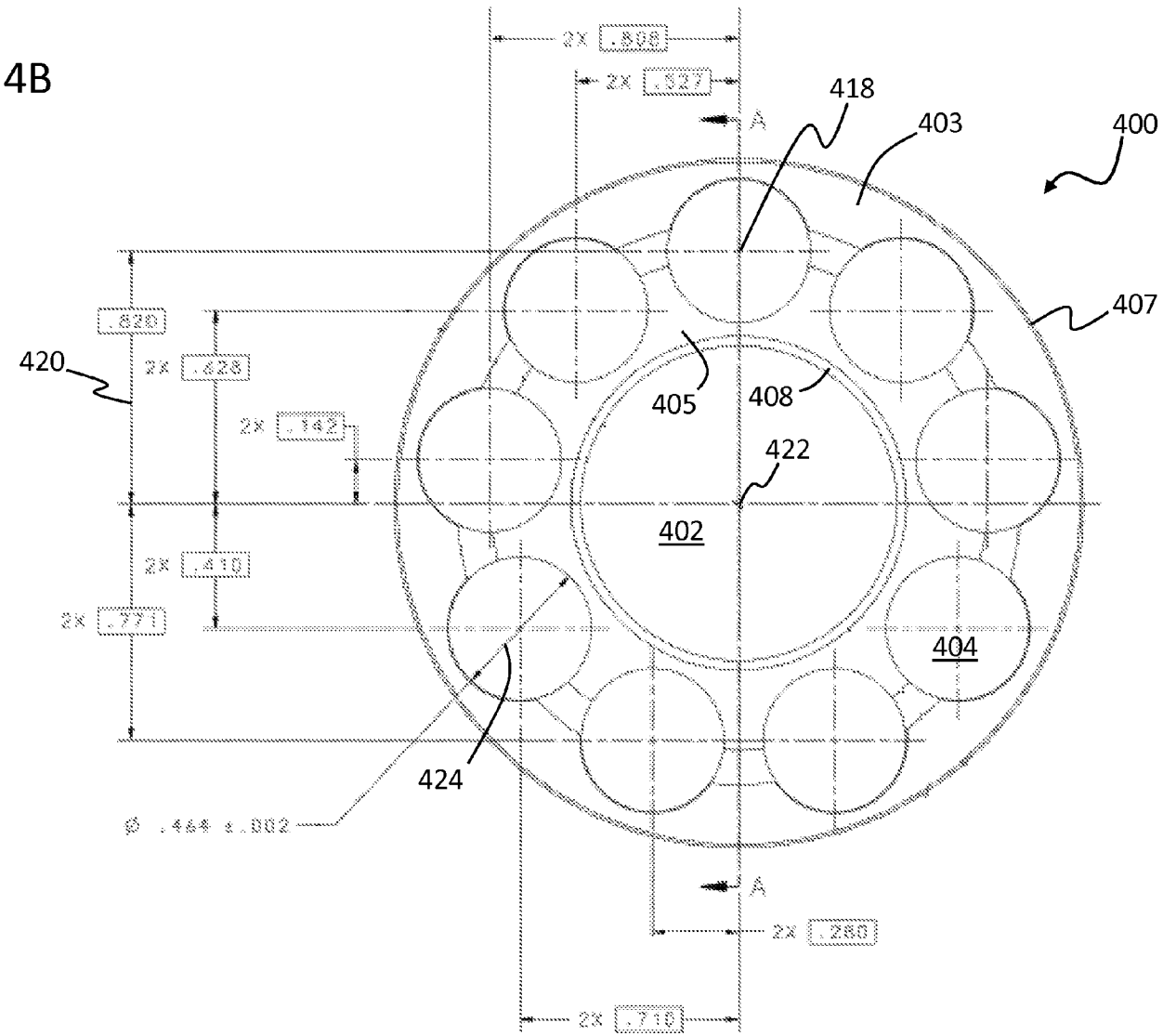
FIG. 4B is a top plan view of the slipper retainer of FIG. 4A.
Figure 4C:
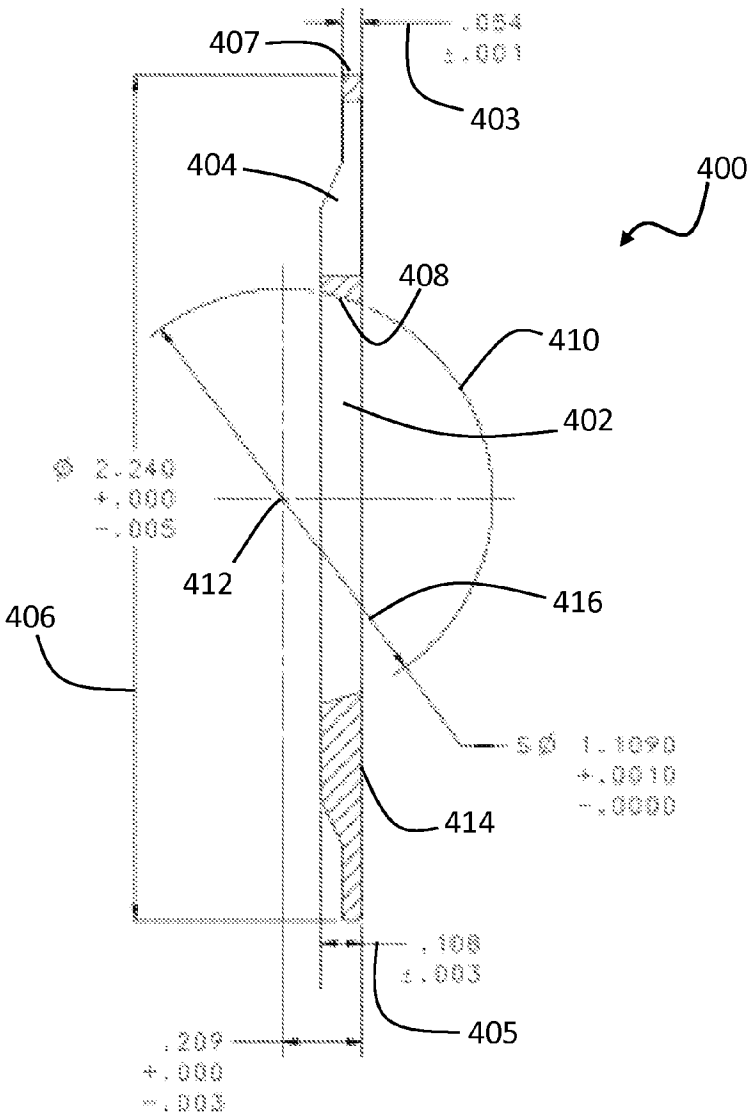
FIG. 4C is a cross-sectional view of the slipper retainer of FIGS. 4A and 4B as viewed along the line A-A of FIG. 4B.

Turning now to FIGS. 4A-4C, various views of an exemplary slipper retainer 400 in accordance with embodiments of the invention are shown. FIG. 4A is an isometric view of the slipper retainer 400; FIG. 4B is a top plan view of the slipper retainer 400; and FIG. 4C is a cross-sectional view of the slipper retainer 400 as viewed along the line A-A of FIG. 4B.

As shown in FIG. 4A, slipper retainer 400 is formed of a circular body 401 that includes a central aperture 402 and a plurality of slipper apertures 404 that pass through the circular body 401. Central aperture 402 is configured to slidably engage with an exterior surface of a slipper retainer ball 328, 330. Each of the plurality of slipper apertures 404 is configured to engage and retain a slipper and a ball of a piston (see FIG. 3).

FIG. 4B is a top plan view of the slipper retainer 400, showing the central aperture 402 with nine slipper apertures 404 distributed evenly about the slipper retainer 400. The slipper apertures 404 are located between a curved surface 408 of circular body 401 that defines the central aperture 402 and an outer edge or circumference 407 of the circular body 401 of the slipper retainer 400. Although nine slipper apertures 404 are shown in FIGS. 4A and 4B, those of skill in the art will appreciate that any number of slipper apertures may be used without departing from the scope of the invention. Further, those of skill in the art will appreciate that the number of slipper apertures should be configured to correspond to the number of slippers and pistons of the hydraulic unit into which the slipper retainers will be installed.

The slipper retainer 400 has a slipper retainer diameter 406 that is about 2.240 inches (5.629 cm), with a variability of about +0.000 inches (0.000 cm) and about −0.005 inches (0.013 cm). The slipper retainer diameter 406 is the full diameter of the circular body 401 of slipper retainer 400. The circular body is configured with two thicknesses, as shown in FIGS. 4A and 4C. A first thickness 403 is at the exterior edge of the slipper retainer 400 and has a thickness of about 0.054 inches (0.137 cm) with a variability of about +/−0.001 inches (0.003 cm). A second thickness 405 is positioned at the interior of circular body 401 and surrounds the central aperture 402. The second thickness has a thickness of about 0.108 inches (0.274 cm) with a variability of about +/−0.003 inches (0.008 cm).

The central aperture 402 has an arcuate or curved surface 408, in the axial direction of the slipper retainer 400, as shown in FIG. 4C. The curved surface 408 is configured to engage with an exterior surface of a retainer ball (see FIG. 3, retainer ball 328). The curvature of the curved surface 408 is defined by a circle or sphere 410 that is located or centered at point 412. Point 412 is located at a distance of about 0.209 inches (0.531 cm) with a variability of about +0.000 inches (0.000 cm) and about −0.003 inches (0.008 cm) from a back surface 414 of slipper retainer 400. The sphere 410 has a diameter 416 of about 1.1090 inches (2.8168 cm) with a variability of about +0.0010 inches (0.0025 cm) and about −0.0000 inches (0.0000 cm). As noted, the circumference of sphere 410 defines the curved surface 408 of the circular body 401 about the central aperture 402 of slipper retainer 400.

As shown in FIG. 4B, each slipper aperture 404 is located about 0.820 inches from the center of the slipper retainer 400. That is, in a radial direction, a slipper aperture center point 418 of the slipper aperture 404 is located a radial distance 420 that is about 0.820 inches (2.083 cm) from a central aperture center point 422. Each slipper aperture 404 has a diameter 424 that is about 0.464 inches (1.179 cm) with a variability of about +/−0.002 inches (0.005 cm).

FIGS. 4A-4C display certain dimensions not discussed above, but are pertinent and relate to various embodiments and/or alternatives of the invention disclosed herein. Thus, the dimensions detailed on the figures, but not discussed above, are incorporated into this specification.

Advantageously, slipper retainers configured in accordance with embodiments of the invention appropriately fit within and operate with specific hydraulic units. Further, advantageously, failure and damage is less likely to occur and efficiency is increased within specific hydraulic units when slipper retainers in accordance with embodiments of the invention are employed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments.

Accordingly, the invention is not to be seen as limited by the foregoing description, but is only limited by the scope of the appended claims.

What is claimed is:

1. A slipper retainer of a hydraulic unit, comprising:

a circular body having a back surface and an outer edge, the circular body defining a diameter of about 2.240 inches;

a central aperture through a center of the circular body, the circular body having a curved surface defining an edge of the central aperture, wherein the curved surface is defined by a sphere that is centered at a point located a distance of about 0.209 inches from the back surface of the body; and a plurality of slipper apertures located between the curved surface of the circular body and the outer edge of the circular body, wherein each slipper aperture of the plurality of slipper apertures has a diameter of about 0.464 inches, wherein the circular body includes a first thickness proximal to the central aperture and a second thickness proximal to the outer edge, the first thickness being greater than the second thickness and extending a first radial extent from the central aperture, the second thickness having a second radial extent, and a tapering surface extending from the first thickness to the second thickness, and wherein the first thickness is about 0.108 inches and the second thickness is about 0.054 inches.

2. The slipper retainer of claim 1, wherein the diameter of the circular body has a variability of about +0.000 inches and about −0.005 inches.

3. The slipper retainer of claim 1, wherein the distance of the point of the center of the sphere has a variability of about +0.000 inches and about −0.003 inches.

4. The slipper retainer of claim 1, wherein the diameter of each of the plurality of slipper apertures has a variability of about +/−0.002 inches.

5. The slipper retainer of claim 1, wherein the plurality of slipper apertures define nine slipper apertures.

6. The slipper retainer of claim 1, wherein the first thickness has a variability of about +/−0.003 inches.

7. The slipper retainer of claim 1, wherein the second thickness has a variability of about +/−0.001 inches.

8. The slipper retainer of claim 1, wherein the sphere defining the curved surface has a diameter of about 1.1090 inches.

9. The slipper retainer of claim 8, wherein the diameter of the sphere has a variability of about +0.0010 inches and about −0.0000 inches.

10. The slipper retainer of claim 1, wherein each of the plurality of slipper apertures is radially located a distance of about 0.820 inches from a center of the circular body.

11. The slipper retainer of claim 1, wherein the curved surface of body is configured to slidably engage with a retainer ball of a hydraulic unit.

* * * * *